US007258899B1

(12) United States Patent
Sharma et al.

(10) Patent No.: US 7,258,899 B1
(45) Date of Patent: Aug. 21, 2007

(54) PROCESS FOR PREPARING METAL COATINGS FROM LIQUID SOLUTIONS UTILIZING COLD PLASMA

(75) Inventors: Ashok K. Sharma, Delhi (IN); Stephen P. Conover, Minneapolis, MN (US)

(73) Assignee: AMT Holdings, Inc., Minnetonka, MN (US)

( * ) Notice: Subject to any disclaimer, the term of this patent is extended or adjusted under 35 U.S.C. 154(b) by 578 days.

(21) Appl. No.: 10/317,359

(22) Filed: Dec. 12, 2002

Related U.S. Application Data

(60) Provisional application No. 60/339,746, filed on Dec. 13, 2001.

(51) Int. Cl.

| | |
|---|---|
| ***B05D 3/06*** | (2006.01) |
| ***H05H 1/46*** | (2006.01) |
| ***C23C 16/56*** | (2006.01) |
| ***C23C 16/50*** | (2006.01) |
| ***C23C 16/06*** | (2006.01) |

(52) U.S. Cl. ..... 427/535; 427/537; 427/569; 427/576; 427/34; 427/254

(58) Field of Classification Search ..... 427/535, 427/536, 537, 539, 540, 571, 576, 244, 245
See application file for complete search history.

(56) References Cited

U.S. PATENT DOCUMENTS

| | | | | |
|---|---|---|---|---|
| 4,464,416 | A * | 8/1984 | Liepins | 427/576 |
| 4,824,444 | A | 4/1989 | Nomura | |
| 5,470,612 | A | 11/1995 | Hotaling et al. | |
| 5,569,634 | A | 10/1996 | Miller et al. | |
| 5,601,979 | A | 2/1997 | Wong | |
| 5,648,582 | A | 7/1997 | Schmidt et al. | |
| 5,766,562 | A | 6/1998 | Chattha et al. | |
| 5,853,819 | A * | 12/1998 | Lelental et al. | 427/537 |
| 5,894,038 | A | 4/1999 | Sharma et al. | |
| 6,136,389 | A | 10/2000 | Conover et al. | |
| 6,383,575 | B1 * | 5/2002 | Badyal et al. | 427/535 |
| 6,426,126 | B1 * | 7/2002 | Conover et al. | 427/488 |

FOREIGN PATENT DOCUMENTS

| | | |
|---|---|---|
| WO | WO99/08803 A | 2/1999 |

OTHER PUBLICATIONS

Robert Weast, editor, CRC Handbook of Chemistry and Physics, 56th edition, CRC press, Cleveland, Ohio, 1974 (no month), excerpts pp. F-209 to F-214.*

Streitwieser et al., Introduction to Organic Chemistry, Macmillan publishing Co., Inc., New York, 1967 (no month), excerpts, p. 1140-1141.*

Recommendations for the Characterization of Porous Solids, J. Rouquerol et al., Pure and Applied Chemistry, vol. 66, No. 8, (1994), no month.

Nomenclature of Structural and Compositional Characteristics of Ordered Microporous and Mesoporous Materials with Inorganic Hosts, (IUPAC Recommendations 2001), L.B. McCusker et al., Pure and Applied Chemistry, vol. 73, No. 2, (Feb. 2001), no month.

Industrial Application of Membrane Separation Processes, Hartmut Bruschke, Pure and Applied Chemistry, vol. 67, No. 6, (1995), no month.

* cited by examiner

*Primary Examiner*—Marianne Padgett
(74) *Attorney, Agent, or Firm*—Haugen Law Firm PLLP

(57) ABSTRACT

A method for depositing metals, metal blends and alloys onto substrate surfaces, including microporous substrates utilizing a plasma operation undertaken at room temperature. In the process, a liquid solution of a monomer or comonomer precursor having a metallic component is utilized to wet the surface of the substrate, with the solvent portion thereafter being removed to leave the substrate surface coated with a dry deposit. The coated substrate is then introduced into a plasma reaction chamber with RF energy being applied across spaced electrodes to create a plasma glow along with the introduction of a plasma supporting gas. The substrate is exposed to the plasma glow for conversion of the precursor to dissociated form to create a deposit consisting essentially of the metallic component in elemental form as a cohesive film on the substrate surface. Preferred metals include such noble metals as platinum, gold and silver, as well as other metals. Preferred precursors include platinum hexafluoro-acetylacetonate, (trimethyl) methylcyclopentadienyl platinum, dimethyl(acetylacetonate) gold, and trimethyl phosphine (hexafluoroacetyl acetonate) silver.

24 Claims, No Drawings

PROCESS FOR PREPARING METAL COATINGS FROM LIQUID SOLUTIONS UTILIZING COLD PLASMA

CROSS-REFERENCE TO RELATED APPLICATION

The present application relates to our now abandoned, Provisional Application Ser. No. 60/339,746, filed Dec. 13, 2001, entitled "PROCESS FOR PREPARING METAL COATINGS FORM LIQUID SOLUTIONS UTILIZING COLD PLASMA".

BACKGROUND OF THE INVENTION

The present invention relates generally to an improved process for preparing metallic coatings, and more particularly to the preparation of ultra-thin metallic coatings utilizing liquid solutions containing metallic components, and wherein these solutions are exposed to plasma. According to the steps of the present invention, certain liquid solutions containing functional groups and metal precursors are initially applied to the surface of a substrate, with the coated substrate then being exposed to mild room temperature cold plasma, whereupon these groups and/or precursors are decomposed. The process occurs rapidly, and conversion to the metallic state likewise occurs rapidly, with the crystalline structure and alloy stoichiometry being subject to close control so as to deliver enhanced yields of a reaction product.

The present invention relates to novel techniques for depositing metals, metal blends and alloys, metal derivatives and complexes onto a variety of substrates including microporous substrates with the technique employing a plasma operation undertaken at substantially room temperature.

Soluble salts of precious metals for service as catalysts may be utilized in either aqueous or organic solvent based solutions to impregnate porous materials. Materials such as for example, zeolites, nanoporous materials, aerogels, activated alumina, microporous, ultrafiltration, nanofiltration and gas permeable membranes may be employed. Surface coat operations on porous or non-porous materials may be utilized for various applications, such as, for example, solar cells, fuel cell membranes such as Nafion, Webs used in barrier packaging films, carbon electrodes used in fuel cells and thin film displays. Aqueous or alcohol-based solutions are preferable for certain solvent sensitive substrate materials such as non-carbon-based aerogels and cellulose, whereas solvent-based solutions are preferable for hydrophobic materials such as Teflon@, PVDF, polypropylenes, and ceramics.

Monomer selection for the metallic component is important, with the preferred monomers being stable to vacuum conditions. Thus, unlike the conventional vapor techniques which rely heavily on the volatility of metal precursors, in the technique of the present invention, stability rather than volatility of the metal complex in vacuum is of primary importance. Also, the more preferred metal complex is a coordination compound of the metal. The use of active plasma for reducing adsorbed metal complexes to thin film of metals have been demonstrated by the present inventors in their U.S. Pat. No. 6,136,389 which substance of which is incorporated by reference herein.

When coated onto hollow fibers, or tubular membranes or flat films made from plastics, ceramics or carbon, films created pursuant to the present invention may serve in a variety of applications such as diesel filters, sterile filters, ion exchange media, biochemical-biowarfare agent filters, bio-organic reactors, and the like.

When coated onto nanoporous materials such as zeolites and other alumina-based materials, aerogels and carbon-based filters, and/or other carbon-based media, films created pursuant to the present invention may serve in a wide variety of catalytic applications in which the metallic coated porous particulate is added to wash coatings, fluidized beds, or alternatively, used to capture certain gases or chemicals from a flow, and thereafter followed by partial or total catalytic breakdown of the captured products.

THE PRIOR ART

Impregnation of porous substrates with noble metals via slurry or dip coatings is known in the prior art such as, for example, U.S. Pat. No. 5,766,562, assigned to Ford Global Technologies, Inc., entitled "DIESEL EMISSION TREATMENT USING PRECIOUS METAL ON TITANIA AEROGEL", issued Jul. 16, 1998. Wash-coat techniques of the prior art are generally followed by calcination. The use of heated gases, such as hydrogen, oxygen or nitrogen are generally required in such processes. High temperatures lead to distortions and/or anomalies in the crystalline structure of the metallic reaction product, and in the case of alloys, such as platinum-ruthenium bimetallics as well. Surface segregation may also occur. Thus, optimization of the noble metal surface composition and chemical state is difficult if not impossible to achieve with such techniques. The temperature used for calcination is generally high which put a limitation on the type of substrate used.

It is also known that thin or ultra-thin atomic layers of metals frequently behave quite differently from their bulk counterparts and interaction of these ultra-thin film of metals with other metals or organic compounds can and does create and/or generate valuable new compounds or materials. For example, incorporating iron with other metals has been found to create new types of magnetic materials. Combining two or more metals through a co-deposition process may produce multi-metallic catalysts having properties different from any of their metallic components, and find particular usage in organic synthesis and fuel cell chemistry. Silver loaded substrates, such as alumina, silica gels, and microporous hollow fibers may be used in antibacterial air and water filters, which find application in food processing industries and also may be useful in fighting bio-terrorism.

Deposition of nanoscale thin film of metals on substrates is not readily nor easily accomplished. In the commonly used technique of metal atom vaporization, one must perform work under high vacuum, at high temperature, and then at low temperature created by liquid $N_2$. These operations require the use of complicated instrumentations and the results not always being positive. As a result, many lead researchers in the field have chosen to abandon such phases of metal vapor chemistry research.

The selection of metal complexes and solvent affects the properties of the ultimate product. Hydrocarbon solvents, such as toluene, are generally preferred for coating on non-polar substrates such as polypropylene or polyethylene, while polar solvents such as ethanol, acetone and the like are typically used for coating on polar ceramic and cellulosic substrates.

SUMMARY OF THE INVENTION

According to the present novel techniques, decomposition of the functional groups deposited along with the metal precursors during the preparation of the substrate is accomplished under extremely mild room temperature cold plasma conditions. This process is quick and conversion to metallic state is very rapid with potentially much better degree of control over the crystalline structure and alloy stoichiometry for selected compositions.

The technique of the present invention may be properly referred to as the "liquid plasma" technique, with a metal precursor being applied on the substrate in solution form followed by exposure to an active plasma which reduces the metal complex to an ultra-thin coating of metal. Solutions of a single metal complex produce pure metal coatings, while solutions of two or more metallic complexes produce coatings of metal blends or alloys. The entire operation is undertaken at room temperature and the conversion is generally instantaneous, producing electrically conductive shiny coatings in certain cases.

The selection of a certain plasma gas and selection of plasma conditions is important for the successful conversion of certain metal complexes to a desired metallic form. In the case of noble metals such as platinum and gold, more flexibility exists in the choice of plasma gas since the electrons produced in plasma are thought to be primarily responsible for the conversion process. In the case of reactive metals such as aluminum, ruthenium, or silver, the proper choice of plasma gas and plasma conditions is relevant for obtaining metallic films with desirable properties.

The concentration of metal complex solutions is also relevant, especially with regard to the development of an electrically conductive metallic surface on a microporous substrate. The surface would generally not be conductive unless a sufficient quantity of metal is present on the substrate surface. At low concentrations, the metal atoms become embedded in the microporous structure and while they can exhibit activity in a catalytic process, they will not possess the continuity required for electrical conductivity on or along the substrate surface.

Non-polar substrates may be treated with inert gas or oxygen plasma to improve compatibility of the treated substrate to solutions of metal complexes in polar solvents. Such treatments are known to improve the critical surface energy of the substrate by creating polar groups or morphological imperfections on the surface.

For many applications it is desirable to produce bimetallic or trimetallic coatings. In such cases, metallic solutions are initially blended together in desired concentration, applied on substrate surfaces, and then treated with active plasma. Concentration and composition of metallic blends may be varied over almost infinite ranges.

The solution containing the desired metallic component may be applied to the substrate by using any one of the known techniques in the literature such as paddle coatings, dip coating, spraying, impregnation, brushing, and the like. Special techniques may be necessary for coating continuous substrates such as hollow fiber, with one such technique being disclosed herein for continuous coating of hollow fiber. Multiple application lines may be employed to expedite commercial production.

The plasma treatment of the coated substrate may be achieved using a known plasma reactor. A capacitively coupled tubular reactor operating at 13.56 Mhz was advantageously employed herein. Custom designed reactors may be utilized if required for continuous coating of substrates such as hollow fiber and films. One such reactor is described in U.S. Pat. No. 4,824,444.

Techniques Utilizing Polymer Films:

In certain applications it may be desirable to apply a permselective polymer film or coating over or under the metallic layer or film. Such polymer coatings may be applied by conventional technique, although in the preferred method of the present invention, the coatings are applied using plasma technique. These coatings allow preferential interaction of the imbedded metal with a component of the mixture or alternatively may allow the byproduct to separate out as it is being formed. These features permit new possibilities in organic, inorganic, and bio-organic syntheses.

The choice of the semipermeable membrane, as these coatings are generally described, depends on the nature of the application. Plasma is known to produce semipermeable membrane on microporous substrates from a variety of monomers, such as silanes, siloxanes, silazanes, hydrocarbons, fluorocarbons, amines, acrylates, and a host of other monomers. Combinations of these two chemistries, metal and polymeric, can provide wide variations in the properties of the final product.

OBJECTS OF THE PRESENT INVENTION

Therefore, it is a primary object of the present invention to provide improved coatings, particularly ultra-thin metallic coatings through cold plasma techniques, wherein solutions containing metallic components are exposed to cold plasma under mild operating conditions to produce uniform, continuous, coherent films which are adherent to surfaces of selected substrates.

It is a further object of the present invention to provide an improved technique for the preparation of ultra-thin metallic films which includes the steps of exposing solutions, including aqueous solutions, of metallic components to cold plasma operations.

Other and further objects of the present invention will become apparent to those skilled in the art upon a study of the following specification and appended claims.

DESCRIPTION OF THE PREFERRED EMBODIMENT

In order to present the steps involved in the techniques of the present invention, the following examples are provided.

GENERAL EXAMPLE

I. Preliminary Steps

1. Substrate Preparation: Plastic substrates such as Celgard microporous films and fibers, PVDF microfilters, Whatman Filter papers, Mitsubishi Rayon microporouos polypropylene and polyethylene fibers, AKZO microporous films and fibers, carbon aerogels, carbon-based cloths (ETEK), zeolite-based powders and membranes, and other such substrates may not require cleaning.

Ceramic substrates, especially microporous Asahi glass tubular membranes, Corning microporous Vycor glass materials, CPG beads, and other materials which tend to absorb impurities, will have to be cleaned before coating for optimal results. Both porous and non-porous substrates may be utilized for this method.

The following have been found to be suitable techniques for cleaning these substrates:

(a) Concentrated $HNO_3$ at 90-95° C. for four hours followed by thorough washing with water and distilled water and solvent exchange with anhydrous methylalcohol followed by drying in oven at 90-110° C. for one to two hours just before the coating.

(b) Ultrasonic cleaning with 4-5% sodiumhypochlorite (NaOCl) solution (10+10 mts) followed by ultrasonic cleaning with distilled water (10+10+10 mts) followed by ultrasonic solvent exchange with methylalcohol (10+10 mts). The substrates are finally dried in an oven at 90-110° C. This method is especially suited for substrates in the form of beads.

(c) Annealing in air or nitrogen flowing oven at 400-500° C. for four hours.

(d) Optional—plasma surface treatment for altering surface wettablity and/or cleaning.

2. Application of Solutions Containing Metallic Components:

(a) Liquid-Based Organometallic Solutions

The chosen clean substrates are contacted by any suitable means such as spray coating, brush or dip coating, roller coating, sponge coating, and the like, with a selected solution of organometallic precursor solution, hereinafter referred to as "monomer or comonomer solutions".

In the case of substrates which do not readily wet upon contact with the selected solution system, a preliminary exposure to a suitable plasma surface treatment as described above may be used to enhance the wettability and spreadability of the solution onto the surface and/or into the substrate's pores.

For application onto continuous substrates, such as Celgard film, or other webbing materials, roller coating or spray coating is suggested. For hollow fibers, both continuous dip coating baths or dipping of entire bundles of fiber are suitable Tubular substrates may be dip coated or spray coated. In some instances, a solvent resistant brush can be used for applying precursor solution. Beads may be impregnated with a solution in any suitable vessel for 5 to 10 minutes followed by filtration and air drying (under nitrogen or vacuum). Impregnated beads may also be dried in an air-forced oven at 40-50° C. for 30 minutes to one hour. Zeolites and activated alumina substrates can be impregnated in the same manner. These methods are meant to only be illustrative of the broad flexibility inherent in this technique for preparing the organometallic precursors for subsequent plasma conversion into metallic coatings and/or complexes.

There are numerous other suitable techniques for applying the organometallic solutions to chosen substrates, and these examples given above are not meant to be limiting the scope of this method. Indeed, the flexibility provided by this approach to applying the precursors allows for almost any substrate, porous or non-porous, of any shape, to be suitably prepared for subsequent plasma conversion.

Obviously, choice of the organometallic material and solvents will influence the time available in between solution coating, drying, and plasma conversion, i.e. the rate of evaporation of the solvents and the rate of volatilization of the organometallics and chemical structure are critical.

II. Plasma Treatment and Conversion

The substrates are subsequently mounted in a clean plasma reactor (tubular or any shape), preferably with a disposable liner sleeve to keep the reactor itself clean from reaction byproducts.

The position of the mounted or moving substrate does not matter, although post-hot electrode (or inter-electrode zone) is preferred. The system is evacuated for 5 to 10 minutes to a pressure range of 15 to 40 mtorr. Other pressures may be used but longer evacuation time and lower pressures risk the depletion of certain adsorbed monomers.

The following plasma treatment conditions are Illustrative only:

Plasma gas=Argon, hydrogen, oxygen, air, blends of oxygen and nitrogen, blends of hydrogen and nitrogen, and other plasma-excitable gases including reactive gases may be employed;

Gas flow rate=1-500 SCCM (with 5-100 SCCM preferred);

System pressure=5-500 mtorr (20-200 mtorr preferred);

Discharge power=1-500 watts (5-150 watts preferred);

Treatment time=15 seconds –30 minutes (1-15 minutes preferred).

The conversion to metal may begin almost instantaneously. In many instances a bright metallic luster begins appearing at one minute of exposure. These conditions may change depending on the size of the reactor, substrate, power, source and plasma coupling mechanisms.

The substrates may, of course, be rotated during the exposure for better uniformity and continuous web or fiber strands may be moved continuously through the plasma.

After plasma treatment, vacuum is released using standard venting techniques and the substrates may be removed for evaluation.

III. Alternative Steps (a) The substrates may be re-exposed as well as re-coated and re-processed if additional metal coating is desirous or if conversion was incomplete.

(b) Multiple layered coatings, i.e. alternating layers of differing metals may also be readily accomplished using this procedure by reprocessing the substrates.

(c) Alloys may also be readily formed by suitable mixing of multiple organometallic compounds in compatible solvents. The process provides for a quick and efficient formation of an almost infinite number of alloyed metals and complexes in various elemental ratios. Techniques such as inkjet printer mixing can be used for preparation of metal complex blend solutions for rapid screening of alloy properties.

(d) The disposition of metallic coatings may also be manipulated readily in terms of their location. For example, by choice of suitable solvents (non-penetrating), a solution may be isolated on the surface of the substrates. By choice of pore penetrating solvents, the metallic coatings may be progressively rendered throughout the porous structure, and result in the formation of tightly adherent coatings.

(e) The substrates may be coated at designated surface locations and/or in certain patterns by use of masking techniques or other methods of controlling the areas of the precursor coating contact. Examples are micromachined, etched, masked and laser oblated surfaces, particularly if rendered microporous or wettable by the organometallic solutions.

IV. Reaction Products (A) In general

The metallic coating may vary from dark brown in appearance to brilliant silver, gold lustres, and rainbow metallic hues. These coatings are found to be unaffected by common monomer solvents such as ethanol and toluene, and have nanometer thick, molecular dimensions.

Highly conductive and adherent metallic coatings can be prepared using this method on a wide host of materials useful for numerous industrial, energy, environmental, and medical applications.

Hydrophobic substrates can be made wettable on their surfaces, as well as in their porous matrices via this process.

These features and properties are particularly advantageous for creation of sensors, fuel cell media, and other electrochemical applications. It is well known in the art that nanometer thick noble metal coatings applied to zeolites of alumina, for example, may enhance adsorption of volatile organic compounds as well as promote their oxidation at lower temperatures compared to thicker coatings. However, conventional coating techniques are severely restrictive in the selection of suitable substrates due to temperature involved in metallic conversion and in alloy compositions and ratios.

(B) Noble Metals as Reaction Products

Platinum compounds such as platinum (II) hexafluoroacetylacetonate in toluene is preferred for coating PVDF and Teflon-based substrates, including Goretex, Tetratec, Nafion. However, any platinum compound soluble in aqueous or organic medium whose functional groups may be decomposed via this plasma treatment may be employed. Plasma treatment may utilize Argon, air, nitrogen, oxygen, hydrogen, and the like.

Other noble metal precursors include but are not limited to palladium acetylacetonate, silver trifluoroacetate, copper trifluoroacetate, platinum (II) acetylacetonate (trimethyl) methylcyclopentadionyl platinum (IV), palladium (II) acetate, glyoxilic palladium (II) glycolite, dimethyl(acetylacetonate) gold (III), trimethylphosphine (hexafluoroacetyl acetonate) silver (I), ruthenocene, ruthenium (ITT) acetylacetonate, dimethyl(trifluoroacetylacetonate) gold, silver 2-ethylhexanoate, copper trifluoroacetylacetonate, bis (2,2,6,6, tetramethyl-3,5 hexafluoroacetylacetonate) copper, tris (2,2,6,6, tetramethyl-3,5-heptanedionate) ruthenium, palladium acetylacetonate, aluminum acetylacetonate, zirconium acetylacetonate, and others.

The techniques of the present invention provide a wide range of suitable metallic compounds as well as an inherent flexibility in choice of metal blends and alloy compositions.

SPECIFIC EXAMPLES

The following specific examples are provided as demonstrative of the techniques of the present invention.

Example 1

A solution of trimethyl phosphine (hexafluoroacetyl acetonate) silver (I) was prepared by dissolving 0.50 g of the complex in 10 ml ethanol (5% w/v) in a clean glass vial. A drop of the solution was applied on a Celgard-2400 film allowed to dry for a few minutes in the air. The film was subsequently mounted in a tubular plasma reactor and treated with Argon plasma, using gas feed rate of 9.11 SCCM, at an average reactor pressure of 76.5 mtorr, RF discharge power 5.0 watt generated from a 13.56 Mhz RF generator. The metal complex changed color within a few seconds. The treatment was continued for five minutes. Fine crystals of shiny silver coatings were formed on the Celgard substrate after the plasma treatment. The silver coatings were conductive and gave a surface resistance of 400 ohms per cm.

Example 2

The silver complex solution prepared in Example 1 was applied on the surface of a 3-inch long microporous glass tube (Grade Ref. MPG-AM, pore size 0.1-20 nm, Asahi Glass Co. Ltd.) by a dropper. After drying in air, the tube was treated with Argon plasma at an average reactor pressure of 75 mtorr, power 10 watt, gas feed rate 9.11 SCCM for 10 minutes. A brownish coating, concentrated more at ends, resulted. The coating had a conductivity of 120-150 ohms.

Example 3

The silver complex solution prepared in Example 1 was applied on a 3"×3" Celgard-2400 microporous film using a Q-tip applicator. The Celgard film was then treated with Argon plasma at an average pressure of 69 mtorr, 5 watt discharge power, feed rate 9.11 SCCM for 3 minutes. A brownish metal coating resulted on Celgard film. The coating was ultrasonically rinsed with ethanol and toluene solvents and left in these solvents for over three months. No elution, discoloration or fading of the coating resulted, confirming their metallic nature and absence of original metal complex on the substrate after the plasma treatment.

Example 4

Two, three, four, five and six drops of silver complex solution prepared in Example 1 were applied at different sites on a Celgard-2400 substrate and treated with Argon plasma at an average pressure of 75 mtorr, 10 watt discharge power, Argon feed rate 9.11 SCCM for 3 minutes. Needle-like shiny metal crystals were observed on the substrate where more than two drops of solution were applied. Golden brown coatings were obtained on substrates where fewer than three drops were applied. The adhesion of metal coating was not good compared to Example 5 below due to less spreading. The metal complex in the above example stayed onto the substrate surface because of poor wetting characteristics of ethanol solution.

Example 5

A fresh solution of trimethyl phosphine (hexafluoroacetyl acetonate) silver (I) was prepared by dissolving 0.25 g of complex in 5 ml toluene (5% w/v). A drop of the solution was applied on Celgard-2400 substrate, dried in air and treated with Argon plasma at an average reactor pressure of 75 mtorr, power 10 watts, Argon feed rate 9.11 SCCM for three minutes. A dark spot was formed on Celgard substrate which had good adhesion to substrate.

Example 6

Controlled pore glass beads (mean pore dia. 75A°, size $20/_{80}$ mesh) obtained from CPG, Inc. were cleaned repeatedly (three times) with a 5% NaOCl solution using ultrasonic cleaner, washed ultrasonically with distilled water until the washing was neutral and cleaned finally with methanol ultrasonically to exchange water. Beads were finally dried in oven at 90-100° C. for one hour. The cleaned CPG beads were treated with the metal solution prepared as in Example 1 in a clean glass vial for 5 minutes, followed by drying in oven at 40-50° C. for 30 minutes or until the beads were freely moving. Argon plasma treatment of beads at 78.5 mtorr average pressure, watt power, Argon feed rate 9.11 SCCM for 10 minutes produced metal coated beads having dark brown color.

Example 7

A Celgard-2400 film was treated with oxygen plasma under the following conditions: oxygen feed rate 6.33 SCCM, average reactor pressure 57 mtorr, discharge power 2 watts, time 1 minute 30 seconds. The plasma treated Celgard film was taken out of the reactor and contacted with 1% and 5% (w/v) solutions of trimethylphosphine (hexafluoroacetylacetonate) silver (I) complex in ethanol, Argon plasma treatment of the film at Argon feed rate of 9.11 SCCM, power 5 watts, pressure 134 mtorr, 2 minutes, produced uniform, well-adhering coating of Ag metal on the Celgard substrate. The oxygen plasma treatment assisted in the uniform spreading and adhesion of the metal.

Example 8

Same as Example 7 except that the Celgard-2400 film was treated with Argon plasma prior to contacting with the Ag-complex solutions in ETOH. Uniform coatings of Ag metal on Celgard-2400 substrate were obtained.

Example 9

Celgard-2400 films treated with drops of ethanol and toluene solvents were treated with Argon plasma under the conditions of Example 1. No change in the appearance of film was noticed, indicating that discoloration in examples 7 and 8 are resulting from metallization of film and do not result from plasma assisted reaction of solvents with the Celgard film.

Example 10

A 2% (w/v) solution of silver (I) trifluoroacetate in toluene was prepared and applied in a continuous manner on the exterior wall of a moving Mitsubishi KPF205M hollow fiber at room temperature. The fiber was moved through the solution of silver complex at a speed of 12-14 ft/mt and wound on a spool. The coated fiber was subsequently treated with Argon plasma in a continuous RF plasma reactor under the following conditions: Argon feed rate 57.6 SCCM, discharge power 40 watts, residence time in reactor 34 seconds, average reactor pressure 51.5 mtorr. A brownish metal looking coating of silver, resistant to toluene solvent, resulted on the hollow fiber. The permeability characteristic of the hollow fiber remained practically unaltered (approximately 10% reduction in nitrogen flux was noticed) after the metal coating.

Example 11

A 5% (w/v) solution of dimethyl(acetylacetonate) Gold (III) was prepared in ethanol solvent and applied with a dropper to macroporous Durapore (PVDF) 0.22 um (pore size) substrate. The substrate was subsequently treated with Argon plasma, at a feed rate of 9.11 SCCM, power 5 watts, reactor pressure 79.5 mtorr, for five minutes. An almost instantaneous metallization of the complex was observed. The resultant coating had a uniform dark color and a conductivity of 100-1000 ohms. Soaking, ultrasonic cleaning test in ethanol, confirmed that the coating was metallic as no elution of coating was observed. The conductivity of the coating improved to 26-45 ohm after ultrasonic cleaning.

Example 12

A 3" length of a porous Vycor® glass tube (40 Angstrom pore diameter) was cleaned by dipping in concentrated nitric acid at 90-95° C. for 4 hours, followed by thorough washing with distilled water and solvent exchange with anhydrous methanol. The cleaned tube was dried in an oven at 90-110° for approximately one hour before impregnating it with the metal complex solution. For impregnation the freshly cleaned and dried tube was dripped for 5 minutes in the dimethyl (acetylacetonate) gold (III) solution prepared in Example 11. After drying in air the tube was treated with Argon plasma in a batch reactor at Argon feed rate of 57.6 SCCM, pressure 58 mtorr, power 20 watts, for 10 minutes. The color of the impregnated tube changed within one minute. A dark, greenish coating having a conductivity of 100-120 ohms was obtained on the Vycor® tube. The ultrasonic cleaning of the coating with ethanol for 30 minutes showed practically no elution; conductivity improved to 60-80 ohms. The color of gold coating darkened on standing in air, but the coating remained conducting and conductivity of 45-50 ohms was observed after 16 days.

Example 13

Same as Example 12 except that 1% solution of metal complex in ethanol was used. A light yellowish non-conducting coating was obtained, perhaps due to low concentration of gold metal on the surface; i.e., not measurable conductivity, coating may be discrete.

Example 14

A palladium metal complex (glyoxilic palladium (II) glycolite) was prepared in the following manner and as described in U.S. Pat. No. 5,894,038:

1.12 gm of palladium (IT) acetate was placed in a round bottomed flask fitted with a dropping funnel, a Teflon coated magnetic stirrer and an Argon gas inlet. 20 ml methanol was drop-wise added to the flask under stirring. When the metal salt was completely dissolved, 0.38 gm of glycolic acid was added in small portions, followed by addition of 0.47 gm of glyoxilic acid monohydrate. The content of the flask was allowed to stir at room temperature for 5-6 hours under Argon atmosphere. A blood red solution was obtained, which was filtered through Whatman (#5) filter paper and diluted by blending with four times its volume in ethanol solvent.

The complex prepared above was applied on a porous Vycor® glass tube by soaking as described in Example 12. Argon plasma treatment of the complex in a production reactor at Argon feed rate of 57.6 SCCM, pressure 59.5 mtorr, power 20 watts, 10 minutes, resulted in a violet color coating which changed its color on storage on the Vycor® tube. Ultrasonic cleaning of the coated tube in methanol for 20 minutes lead to no elution, confirming transition of complex to metal state.

Example 15

Activated alumina powder (150 mesh), basic, surface area 155 $m^2$/gm, obtained from Aldrich Chemical Company was treated with a 1.2% (w/v) solution of trimethylphosphine (hexafluoroacetylacetonate) silver (I) solution in toluene in a glass vial, filtered and dried in an oven at 40-50° for approximately one hour or until the powder was free flowing. The impregnated alumina was subsequently treated with Argon plasma at feed rate of 9.11 SCCM, pressure 84 mtorr, power 10 watts for six minutes. A lightly colored toluene non-extractable coating of silver metal was obtained on alumnina substrate.

Example 16

A 5% (w/v) solution of tris (2,2,6,6 tetramethyl-3,5-heptanedianate) ruthenium (III) in toluene was prepared and applied on a Durapore 0.22 um macroporous substrate from a dropper. After drying, the substrate was treated with oxygen plasma at feed rate of 6.33 SCCM, reactor pressure 58 mtorr, power 10 watts, and time 5 minutes. A dark pinkish metallic coating that was non-extractable, with toluene was obtained.

Example 17

Example 16 was repeated using Argon plasma, at Argon feed rate of 9.11 SCCM, power 5 watts, pressure 79 mtorr, time 5 minutes. Color of complex changed. The coating when extracted with toluene in an ultrasonic bath gave very little or almost no elution.

Example 18

Example 17 was repeated using a 2% (w/v) solution of ruthenium (III) acetylacetonate in acetone and a saturated solution of ruthenocene. While ruthenocene spot was not even visible after Argon plasma treatment, ruthenium (III) acetyl acetonate produced a faint coating on Durapore substrate.

Example 19

Solution of ruthenium complex prepared in Example 16 was applied on a Celgard-2400 substrate using dropper. Exposure of the substrate to Argon plasma at feed rate of 9.11 SCCM, pressure 72 mtorr, power 5 watts, time 10 minutes, produced shiny lustrous crystals of ruthenium metal on Celgard substrate.

Example 20

A 1% (w/v) solution of platinum (II) hexafluoroacetylacetonate was prepared in toluene solvent and applied to a Durapore 0.22 um macroporous substrate by dropper. Exposure of the substrate to Argon plasma, within 3 minutes of keeping the substrate in vacuum, at Argon feed rate of 9.11 SCCM, pressure 78.5 mtorr, power 10 watts, time 5 minutes, produced a dark, grey colored coating on the Durapore substrate which was insoluble in toluene solvent. Longer exposure to vacuum lead to volatilization of the metal complex (prior to plasma exposure) and only a very faint coating was obtained.

Example 21

Example 20 was repeated using Celgard-2400 microporous film as the substrate and oxygen plasma, at oxygen feed rate 6.33 SCCM, pressure 65 mtorr, power 10 watts, time 5 minutes. Shiny lustrous crystals of platinum metal were obtained on the Celgard-2400 substrate.

Example 22

Example 20 was repeated using 5% (w/v) solution of (trimethyl) methylcyclopenta dienyl platinum (IV') in toluene. Argon plasma was initiated after 3 minutes of placing the substrate in vacuum chamber. Non-extractable coating of platinum metal was obtained.

Example 23

A 2% (w/v) solution of platinum (II) acetylacetonate in a (75:25) blend of toluene and acetone solvents was applied to Celgard-2400, Whatman #5 filter paper, Durapore (0.22 um) substrates and treated with Argon plasma. Shiny crystals of platinum metals were obtained on Celgard-2400 substrate and a dark greyish coating was obtained on Durapore and Whatman #5 substrates. The coatings were non-extractable in toluene and acetone solvents. The Argon plasma treatment was carried out in a batch reactor using Argon feed rate of 57.6 SCCM, power 40 watts, pressure 51 mtorr, and treatment time of 3 minutes. The substrates were evacuated for one hour and 30 minutes before the plasma treatment.

Example 24

(A) A Nafion membrane member 418 is available commercially from Aldrich. The membrane (A) was 0.017 inch thick and exhibited no conductivity as purchased. After boiling in distilled water for 2 hours, the Nafion membrane was allowed to cool until tepid. It was then dipped into a 1% (w/v) platinum hexafluoroacetylacetonate solution in toluene after blotting dry with a lint-free cloth.

The Nafion was soaked for two minutes and then removed for air drying. Thereafter, the Nafion was loaded into a lab scale plasma reactor such that the entire surface of the membrane was exposed to vacuum within standard reactor tube system.

The system was pumped down to 10 mtorr range before Argon gas was added. Argon flow set at (5% of 100 SCCM calibrated for methane) resulting in pressure inlet reading of 121 mtorr and outlet pressure of 28 mtorr. Glow was struck with a corona match and RF power was maintained at 10 watts for a total of 8 minutes.

The Nafion appeared brilliant, shiny, metallic after 5 minutes of exposure, the plasma treatment was continued for another 3 minutes, and then the membrane was removed from the system.

One side of Nafion was conductivity reading of 2400 ohms, and the other side read 10K ohms per cm.

(B) Next, a larger sample of Nafion 417 was placed into a larger scale plasma reactor system after first being subjected to the same initial boiling in water followed by dipping into 1% PtHFAA in toluene solution as described above.

The Argon was supplied at 30% on a 100 ccsm mass flow meter calibrated for nitrogen. Pressure at the inlet read 76 mtorr and outlet read 39.8 mtorr. Plasma was initiated at 30 watts and within two minutes bright, shiny, metallic lustre appeared on top side of the Nafion membrane. Total plasma exposure time was 10 minutes. Conductivity of Nafion before treatment measured zero. Conductivity post-platinization measured 500 ohms per cm.

(C) The Nafion sample from Example 30(B) was mounted inside a lab scale fuel cell assembly available commercially from Paxton Patterson. The PEMPOWER 1-ECO produces and uses oxygen and hydrogen from deionized water. The small kit utilizes Proton Exchange Membranes made of Nafion in an electrolyzer (PEMEL-PRO) electrode surface area of 16 $cm^2$ and in the fuel cell itself, which also has 16 $cm^2$ surface area. The fuel cell generates 600 mW when it is powered by oxygen and 30 mW when powered by air. Voltage range is 0.3-0.9 volts.

The Applied Membrane Technology platinized Nafion was substituted for the Nafion membrane contained in the fuel cell, and the platinized carbon electrodes located on both sides of the Nafion were removed. Without the carbon pads, a gap remained between Applied Membrane Technology's platinized Nafion and the fuel cell contact grid, so one of the carbon H-Tec pads was put back on the fuel cell's cathode side.

With Applied Membrane Technology's platinized Nafion forming the anode side of the fuel cell, the cell immediately ramped up to 0.6 volts and spun the attached propeller.

The fuel cell as supplied by vendor required anywhere from 30 minutes to one hour before generating enough power to spin the propeller at 0.5 volts.

A series of experimental membranes were then produced utilizing this novel technique for adding noble metals to membranes. The membranes were based on Nafion, Celgard polypropylene and carbon-based aerogels, as well as carbon cloths. Platinum and platinum/ruthenium alloys were both employed as the metallic coatings.

Example 25

A 1:1 blend of platinum (II) hexafluoroacetyl-acetonate; solution (1% w/v) in toluene and tris(2,2,6,6, tetramethyl 3,5 heptanedianate) ruthenium (III) solution (1% w/v in toluene) was prepared by mixing equal volumes of two solutions in a clean glass vial. The blend was applied to a Durapore (0.22 μm) macroporous substrate with a dropper and treated with Argon plasma at a feed rate of 9.11 SCCM, pressure 81 mtorr, power 10 watts, time 10 minutes, just after 4 minutes of keeping the substrate in vacuum chamber. Toluene resistant metal blend coatings were obtained on the substrate.

Example 26

Example 24 was repeated using a double-sided Etek carbon electrode (carbon only) substrate. The substrate was saturated with the blend of platinum and ruthenium complex solution prepared in Example 24, using a dropper, dried in air and treated with Argon plasma at feed rate of 57.6 SCCM, pressure 60 mtorr, power 40 watts, time 10 minutes in a batch reactor. The plasma treatment was carried on both sides of the electrode substrate by positioning the substrate in the plasma reactor in such a way that both sides of the substrate were exposed to Argon plasma. Examination of the substrate under a microscope showed a significant change in the appearance of the substrate after plasma treatment.

Example 27

Example 25 was repeated using a solution of platinum (II) hexafluoroacetylacetonate (3% w/v in toluene) instead of the blend.

Example 28

The Pt/Ru and Pt impregnated carbon electrodes prepared in Examples 26 and 27 respectively were used in a fuel cell assembly available commercially from Paxton Patterson, in place of the manufacturer supplied electrodes. The Pt/Ru coated electrode was used as anode and Pt coated electrode as cathode. The response of the fuel cell was found to be better than the response with the original electrodes. The voltage jumped from zero to 0.636V within two minutes and remained stable for 72 hours.

Example 29

A few crystals of trimethylphosphine (hexafluoro-acetylacetonate) silver (I) were placed on the adhesive side of a masking tape and exposed to hydrogen plasma under the following conditions: hydrogen feed rate 6.95 SCCM, reactor pressure 92 mtorr, power 10 watts, time 5 minutes. Crystals developed a shiny, silvery appearance, characteristics of silver metal.

Example 30

Example 29 was repeated using oxygen plasma under the following conditions: oxygen feed rate 6.95 SCCM, reactor pressure 64 mtorr, power 5 watts, time 5 minutes. Dull looking crystals were obtained, which on treatment with hydrogen plasma, under the conditions of Example 29, turned shiny and silvery in appearance.

Example 31

In a manner similar to Example 10, solutions of copper, platinum and a blend of platinum/ruthenium were applied to hollow microporous fibers made of polypropylene KPF205M available commercially from Mitsubishi Rayon of Japan. In all cases, the metals solutions were rapidly converted to metallic form during the plasma exposure. Several kilometer lengths of each fiber type composite were produced on spools continuously in a commercial scale reactor.

Example 32

Durapore disc membranes (GVHP04700) 9.6 $cm^2$, 0.22 micron pore size and hydrophobic were coated with silver via the technique of the present invention. The resulting membrane was wettable and water break through pressure was lowered from over 40 psi to 10 psi.

Example 33

Ceparation B. V. hollow fibers, 0.3 micron pore size, made of aluminum oxide coated with silver, platinum, and gold alloys were undertaken pursuant to the technique of the General Example set forth hereinabove.

Example 34

Carbon aerogel operations were treated pursuant to the technique of General Example hereinabove.

Example 35

Experiments with Sn and Cu operations were undertaken pursuant to the technique of the General Example hereinabove.

Example 36

Alloys of Ag/Au, Ag/Cu, Ag/Pt onto Durapore PVDF operations were undertaken pursuant to the technique of the General Example set forth hereinabove.

Example 37

Palladium onto Durapore operations were undertaken pursuant to the technique of the General Example set forth hereinabove.

Example 38

Hollow fiber ceramic membranes available from Ceparation B. V. Netherlands were coated uniformly with a solution of platinum acetylacetonate, 2% (w/v) in 55:45 toluene/acetone mixture with a brush, dried in air and treated with Argon plasma at a gas flow rate of 40 SCCM, average discharge pressure of 85 mhm, at 40 watt in an RF plasma reactor for 5 minutes. Blackish coating having a linear resistance of 47 ohms/cm resulted. The coatings were heat aged at 200° C. for 4 hours and at 300° C. for 1 hour to remove residual organics. The conductivity of coatings improved after heat aging.

Example 39

Ceramic Asahi glass tubular membrane coating with silver operations were undertaken pursuant to the technique of the General Example set forth hereinabove.

Example 40

Activated alumina, available commercially from Aldrich Chemical Company, 150 mesh, coated with platinum and with silver operations were undertaken pursuant to the technique of the General Example set forth hereinabove.

Example 41

Goretex platinized PTFE operations were undertaken pursuant to the technique of the General Example set forth hereinabove.

Example 42

Tetratex (PTFE) platinized operations were undertaken pursuant to the technique of the General Example set forth hereinabove.

GENERAL CONSIDERATIONS

Solvents

Useful solvents include water, sodium hydroxide and organics such as toluene, ethanol, isopropanol, acetone, MEK, DMF, and ethylacetate, to name a few. Obviously, the selection of solvents may be determined by those skilled in the art based on optimization of precursor solubility in selected solvent and solvent compatibility with the substrate. Many useful membrane substrates are highly resistant to organic solvents (glass, metal oxides, ceramics, carbon, Teflon, polyethylene and polypropylene, polyamides, PVDF, and nylons). Thus a wide array of metal coated films, fibers, webs, powders, and other shaped articles may be advantageously tailored to particular uses via this novel metallization technique.

Substrate Selection and Properties (A) Organic Substrates:

Because of the mild operating conditions of the present invention, substrates useful in the practice of this invention vary widely. The only requirement is that the surface of the substrate is such that the initiating agent can chemically and/or physically absorb, adsorb, or absorb and adsorb on, in, or on and in said substrate. Useful substrates may be formed of organic materials, inorganic materials, or a combination of such materials. Illustrative of useful inorganic substrates are materials such as carbon black, graphite, mica, clay, glass, ceramics, $SiO_2$ and the like. In certain applications, solvent systems may be blended in order to apply active coatings onto a porous surface, with the liquid then being manipulated so as to provide a mechanism for controlling the activity levels at various points along a depth filter.

Useful organic substrates include polymeric materials such as thermoset and thermoplastic polymers. Thermoset polymers for use in the practice of this invention may vary widely. Illustrative of such useful thermoset polymers are alkyds derived from the esterification of a polybasic acid such as phthalic acid and a polyhydric alcohol such as glycol; allylics such as those produced by polymerization of dialkyl phthalate, dialkyl isophthalate, dialkyl maleate, and dialkyl chlorendate; amino resins such as those produced by addition reaction between formaldehyde and such compounds as melamine, urea, aniline, ethylene urea, sulfonamide and dicyandiamide; epoxies such as epoxy phenol novolak resins, diglycidyl ethers of bisphenol A and cycloaliphatic epoxies; phenolics such as resins derived from reaction of substituted and unsubstituted phenols such as cresol and phenol with an aldehyde such as formaldehyde and acetaldehyde; polyesters, silicones; and urethanes formed by reaction of a polyisocyanate such as 2,6-tolyene diisocyanate, 2,4-tolylene diisocyanate, 4,4-diphenylmethane diisocyanate, 1,6-hexamethylene diisocyanate and 4,4'-dicyclohexylmethane diisocyanate with a polyol such as polyether polyol (trimethylol propane, 1,2,6-hexanetriol, 2-methyl glycoside, pentaerythitol, poly(1,4-tetramethylene ether) glycol, sorbitol and sucrose), polyester polyols such as those prepared by esterification of adipic acid, phthalic acid and like carboxylic acids with an excess of difunctional alcohols such as ethylene glycol, diethylene glycol, propanediols and butanediols.

Thermoplastic polymers for use in the formulation of the composition of the present invention may vary widely. Illustrative of such polymers are polyesters such as poly (glycolic acid), poly(ethylene succinate), poly (ethylene adipate), poly(tetramethylene adipate), poly (ethylene azelate), poly(ethylene sebacate), poly (decamethylene adipate), poly(decamethylene sebacate) poly(1,2-dimethylpropiolacetone), poly(pivaloyl lactone), poly(para-hydroxybenzoate), poly(ethylene oxybenzoate), poly (ethylene isophthalate), poly (ethylene terephthalate), poly (decamethylene terephthalate), poly(hexamethylene terephthalate), poly (1,4-cyclohexane dimethylene terephthalate), poly (ethylene-1,5-naphthalate), poly(ethylene-2,6 naphathalate), poly(1,4-cyclohexylidene dimethylene-terephthalate) and the like; polyamides such as poly(4-aminobutyric acid) (Nylon 4), poly(6-amino-hexanoic acid) (Nylon 6), poly(7-aminoheptanoic acid) (Nylon 7), poly(8-aminooctanoic acid) (Nylon 8), poly(9-aminononanoic acid) (Nylon 9), poly(10-aminodecanoic acid (Nylon 10), poly (11-aminoundecanoic acid) (Nylon 11), poly(12-aminododecanoic acid) (Nylon 12), poly (hexamethylene adipamide) (Nylon 6,6), poly (heptamethylene pimelamide) (Nylon 7,7), poly (octamethylene suberamide) (Nylon 8,8), poly (hexamethylene sebacamide) (Nylon 6,10), poly (nonamethylene axelamide) (Nylon 9,9), poly (decamethylene azelamide) (Nylon 10,9), poly (decamethylene sebacamide) (Nylon 10,11), poly [bis(4-amiknocyclohexyl)methane-1, 10-decanedicarboxamide] (Quiana)(trans), poly(m-xylene adipamide), poly(p-xylene sebacamide), poly(2,2,2-trimethylhexamethylene terephthalamide), poly(piperazine sebacamide), poly (metaphenylene isophthalamide) (Nomex), poly (p-phenylene terephthalamide) (Kevlar), and the like; polycarbonates such as poly[methane bis(4-phenyl)carbonate], poly[1,1-ethane bis(4-phenyl)carbonate], poly[2,2-propane bis(4-phenyl)carbonate], poly[1,1-butane bis(4-phenyl)carbonate], poly[1,1-(2-methyl propane)bis(4-phenyl) carbonate], poly[2,2-butane bis(4-phenyl)carbonate], poly [2,2-pentane bis(4-phenyl)carbonate], poly[4,4-heptane bis (4-phenyl)carbonate], poly 1,1-(1-phenyl-ethane)bis(4-phenyl)carbonate], poly [diphenylmethane bis(4-phenyl) carbonate], poly[1,1-cyclopentane bis(4-phenyl) carbonate], poly[1,1-cyclohexane bis(4-phenyl) carbonate], poly [thio bis(4-phenyl) carbonate], poly[2,2-propane bis-[4-(2-methyl phenyl]carbonate, poly]2,2-propane bis-[4-(2-m\chlorophenyl)]carbonate, poly[2,2-propane bis-[4-(2,6-dichlorophenyl)]carbonate], poly[2,2-propane bis-[4-(2,6-dibromophenyl)]carbonate], poly[1,1-cyclohexane bis-[4-(2,6 dichlorophenyl) carbonate], and the like; polymers derived from the polymerization of alpha., .beta.-unsaturated monomers such as polyethylene, acrylonitrile/butadiene/styrene terpolymer, polypropylene, poly(1-butene), poly (3-methyl-1-butene), poly(1-pentene), poly(4-methyl-1-pentene), poly(1-hexene), poly(5-methyl-1-hexene), poly (1-octadecene), polyisobutylene, poly(isoprene), 1,2-poly(1,3-butadiene) (isostatic), 1,2-poly(-butadiene)(syndiotatic), polystyrene, poly(.alpha.-methylstyrene), poly(2-methylstyrene), poly(4-methylstyrene), poly(4-methoxystyrene), poly (4-phenylstyrene), poly(3-phenyl-1-propene), poly(2-chlorostyrene), poly(4-chlorostyrene), poly(vinyl fluoride), poly (vinyl chloride), poly(vinyl bromide), poly(vinylidene fluoride), poly(vinylidene chloride), poly(tetrafluoroethylene) (Teflon), poly(chlorotri-fluoroethylene), poly(vinylcyclopentane), poly(vinylcyclohexane), poly(.alpha.-vinylnaphthalene), poly(vinyl alcohol), poly(vinyl methyl ether), poly(vinyl ethyl ether), poly(vinyl propyl ether), poly(vinyl isopropyl ether), poly(vinyl butyl ether), poly(vinyl isobutyl ether), poly(vinyl sec-butyl ether), poly(vinyl tert-butyl ether), poly(vinyl hexyl ether), poly(vinyl octyl ether), poly (vinyl methyl ketone), poly(methyl isopropenylketone), poly(vinyl formate), poly(vinyl acetate), poly(vinyl propionate), poly(vinyl chloroacetate), poly(vinyltrifluoroacetate), poly(vinyl benzoate), poly(2-vinylpyridine), poly(vinylpyrrolidinone), poly(vinyl-carbazole), poly(acrylic acid), poly(methyl acrylate), poly(ethyl acrylate), poly(propyl acrylate), poly(iso-propyl acrylate), poly(butyl acrylate), poly(isobutyl acrylate), poly(sec-butyl acrylate), poly(tert-butyl acrylate), poly(methacrylic acid), poly(methyl methacrylate), poly(ethyl methacrylate), poly(propyl methacrylate), poly(isopropyl methacrylate), poly(butyl methacrylate), poly(isobutyl methacrylate), poly(sec-butyl methacrylate), poly(tert-butyl methacrylate), poly(2-ethylbutyl methacrylate), poly(hexyl methacrylate), poly(octyl methacrylate), poly(dodecyl methacrylate), poly(octadecyl methacrylate), poly(phenyl methacrylate), poly(benzyl lmethacrylate), poly(cyclohexyl methacrylate), poly(methyl chloroacrylate), polyacrylonitrile, polymethacrylonitrile, polyacrylamide, poly(N-isopropylacrylamide), and the like; polydienes such as poly(1,3-butadiene) (cis), poly(1,3-butadiene) (trans), poly(1,3-butadiene) (mixt.), poly(1,3-pentadiene) (trans), poly(2-methyl-1,3-butadiene) (cis), poly(2-methyl-1,3-butadiene) (trans), poly(2-methyl-1,3-butadiene (mixt.), poly(2-tert-butyl-1,3-butadiene) (cis), poly(2-chloro-1,3-butadiene) (trans.), poly(2-chloro-1,3-butadiene) (mixt.) and the like; polyoxides such as poly(methylene oxide), poly(ethylene oxide), poly(tetra-methylene oxide), poly(ethylene formal), poly(tetra-methylene formal), polyacetaldehyde, poly(propylene oxide), poly(hexene oxide), poly(octene oxide), poly(trans-2-butene oxide), poly(styrene oxide), poly(3-methoxypropylene oxide), poly(3-butoxypropylene oxide), poly(3-hexoxypropylene oxide), poly (3-phenoxy-propylene oxide), poly(3-chloropropylene oxide), poly[2,2-bis(chloromethyl)-trimethylene-3-oxide] (penton), poly(2,6-dimethyl-1,4-phenylene oxide) (PPO), poly(2,6-diphenyl-1,4-phenylene oxide) (Texax, P30), and the like; polysulphides such as poly(propylene sulphide), poly(phenylene sulphide) and the like; polysulfones such as poly[4,4'-isopropylidene diphenoxy di(4-phenylene) sulphone], noryl, and mixtures thereof.

In certain preferred embodiments of the present invention, useful substrates are prepared from polymeric materials which are swellable by an appropriate organic or inorganic solvent to allow more efficient infusion of the initiating agent to surface layers of the substrate, which facilitates the anchoring of the subsequently formed conjugated backbone chain segments on the surface of the substrate. More preferred polymeric substrates are fabricated from polymers which contain atoms other than carbon and nitrogen.

(B) Inorganic Substrates:

Certain inorganic substrates may be employed as well, including alumina, alumina powders (alpha), titania in the Rutile form, zirconia, high porosity or high surface-activated carbons, bohmite, silica or silica gel, silicon carbide, clays, and silicates including synthetics and naturally occurring forms (china clay, diatomaceous earth, fuller's earth, Kaolin, kieselguhr, and the like, titanium dioxide, zirconium dioxide, chromium oxide, zinc oxide, magnesia, thoria, boria, silica-alumina, silica-magnesia, chromia-alumina, alumina-boria, silica-zirconia, and the like, crystalline alumino silicates natural and synthetics such as mordenite and/or faujasite, either in the hydrogen form or in a form treated with multi-valent cations, or combinations of these inorganic groups. Conductive substrates such as carbon aeroqels as well as non-conductive substrates may be utilized. Fullerenes, aerogels, zeolites, and other nanoporous structures may be utilized. Microporous, ultraporous, and/or nanoporous glass and ceramics in fiber forms, tubular forms, or as monoliths and the like are also suitable.

(C) Ceramic Substrates:

Ceramic hollow fibers created pursuant to the procedures set forth in the General Example as well as in Examples 38, 39 and 40 exhibit good electrical properties as well as good platinum adhesion. It has been found that the utilization of separate coating operations permit the preparation of films of thicker cross-section with enhanced adhesion. This procedure is preferred over a procedure wherein a single coating is applied, it having been found that while the thicker coatings exhibit increased conductivity, the adhesion property may diminish as coating thickness increases. Utilization of multiple coatings provides a good balance between these properties.

(D) Substrate Pre-Treatment:

Substrates which do not readily wet with particular solvents may have their surfaces rendered more suitable for precursor application by pre-treatments such as boiling in water, or plasma surface treatments. For purposes of processes pursuant to the present invention, the usable substrates are those which are readily wet with the solvent system employed in the overall application. In this connection, surfaces of substrates which are considered difficult to render wettable, such as Teflon® and/or certain compounds of ruthenium may be treated pursuant to pretreatments to modify the surface characteristics so as to render the substrate wettable. Any surface treatment which at least temporarily alters the surface energy of the material should be acceptable for pre-treatment. The substrates may be repeatedly coated using the technique of the present invention to form multi-layers, or interdispersed metals, or after such initial metallization following this novel technique, they may be electrolytically coated by more conventional methods with additional metal.

(E) Substrate Configuration:

It will be appreciated that substrates may be fabricated in a variety of configurations or shapes including tubular members with AG/PT strips formed thereon, or alternatively, the substrate may be in the form of a flat plate.

It will be appreciated that various modifications in the process and other steps in the novel operation of the present invention may be undertaken without departing from the spirit and scope of the invention.

What is claimed is:

1. The method of preparing continuous thin metallic films upon porous substrate surfaces which includes the steps of:

(a) selecting a porous substrate having open voids exposed to a surface of said porous substrate, said open voids having a minimum diameter of at least 2.5 angstroms and a minimum depth that is greater than the respective minimum diameter;

(b) selecting a precursor selected from the group consisting of a monomer, a comonomer, and combinations thereof, said precursor having one or more metallic components and dissolving said precursor in a liquid solvent to create a mixture of said precursor in solution;

(c) wetting said surface of said porous substrate with said precursor solution to coat said porous substrate;

(d) removing said liquid solvent from said precursor solution through removal of solvent from said surface to provide a substantially solvent-free residue of said precursor on said porous substrate;

(e) providing a plasma reaction chamber with a pair of spaced apart electrodes therewithin or other suitable mechanism for producing the plasma glow and with said reaction chamber having a configuration for supporting a plasma glow therewithin and for receiving said precursor coated porous substrate;

(f) introducing said precursor coated porous substrate into said reaction chamber;

(g) evacuating the atmosphere from within said reaction chamber and applying RF energy across said electrodes to initiate a plasma glow zone and maintaining said plasma glow with said application of RF energy while simultaneously introducing a plasma supporting gas to said plasma reaction chamber; and (h) said plasma glow converting said precursor to dissociated form through separation of said one or more metallic components from said precursor to form a deposit consisting essentially of said one or more metallic components in elemental form as a cohesive film on the surface of said substrate, the combination of the cohesive film on said porous substrate forming a coated substrate media, said coated substrate media allowing fluid transport into and out from said open voids.

2. The method of claim 1 wherein said reaction chamber has an inlet end and an outlet end, and wherein said precursor coated substrate is moved through said plasma zone within said reaction chamber between said inlet end and said outlet end.

3. The method of claim 2 wherein movement of said coated substrate is substantially continuous.

4. The method of claim 2 wherein said substrate mount comprises spaced apart supply and take-up receiving spools.

5. The method of claim 2 wherein said substrate mount comprises an endless conveyor.

6. The method of claim 1 wherein said reaction chamber is generally tubular in configuration.

7. The method of claim 1 wherein said electrodes are moved substantially continuously.

8. The method of claim 1 wherein said metallic component is a noble metal.

9. The method of claim 8 wherein said noble metal is selected from the group consisting of platinum, silver, and gold.

10. The method of claim 1 wherein said precursor is platinum hexafluoroacetylacetonate.

11. The method of claim 1 wherein said precursor is (trimethyl) methylcyclopentadienyl platinum.

12. The method of claim 1 wherein said precursor is dimethyl (acetylacetonate) gold.

13. The method of claim 1 wherein said precursor is trimethyl phosphine (hexafluoroacetyl acetonate) silver.

14. The method of claim 1 wherein the surface of said porous substrate is pretreated for subsequent wetting by said precursor solution.

15. The method of claim 1 wherein said RF energy is delivered at a frequency of substantially 13.56 MHz.

16. The method of claim 1 wherein a magnetic field is added across said reaction zone.

17. The method of claim 1 wherein said plasma supporting gas is selected from the group consisting of argon, krypton, xenon, helium, and nitrogen.

18. The method of claim 1 wherein said plasma supporting gas is selected from the group consisting of oxygen, hydrogen, and gaseous fluorocarbon compounds.

19. The method of claim 1 wherein the inner walls of said reaction chamber are covered with a removable liner.

20. The method of claim 1 wherein said porous substrate consists essentially of a ceramic and wherein said precursor comprises a platinum compound.

21. The method of claim 20, including applying a second precursor having a silver compound to said coated substrate media and thereafter re-exposing the coated substrate media to the operations of steps (c) through (h) inclusive.

22. The method of claim 1 wherein said precursor comprises a silver compound.

23. The method of claim 22, including applying a second precursor having a platinum compound to said coated substrate media and thereafter re-exposing the coated substrate media to the operations of steps (c) through (h) inclusive.

24. A method of preparing continuous thin metallic films upon porous substrate surfaces, which method includes the steps of:

(a) selecting a porous substrate having open voids exposed to a surface of said porous substrate;

(b) selecting a precursor selected from the group consisting of a monomer, a comonomer, and combinations thereof, said precursor having one or more metallic components and dissolving said precursor in a liquid solvent to create a mixture of said precursor in solution;

(c) wetting said surface of said porous substrate with said precursor solution to coat said porous substrate;

(d) removing said liquid solvent from said precursor solution through removal of solvent from said surface to provide a substantially solvent-free residue of said precursor on said porous substrate;

(e) providing a plasma reaction chamber with a pair of spaced apart electrodes therewithin or other suitable mechanism for producing the plasma glow and with said reaction chamber having a configuration for supporting a plasma glow therewithin and for receiving said precursor coated porous substrate;

(f) introducing said precursor coated porous substrate into said reaction chamber;

(g) evacuating the atmosphere from within said reaction chamber and applying RF energy across said electrodes to initiate a plasma glow zone and maintaining said plasma glow with said application of RF energy while simultaneously introducing a plasma supporting gas to said plasma reaction chamber; and (h) said plasma glow converting said precursor to dissociated form through separation of said one or more metallic components from said precursor to form a deposit consisting essentially of said one or more metallic components in elemental form as a cohesive film on the surface of said substrate, the combination of the cohesive film on said porous substrate forming a coated substrate media, said coated substrate media allowing fluid transport into and out from said open voids.

* * * * *